US007325630B2

(12) United States Patent
Takhaundinov et al.

(10) Patent No.: US 7,325,630 B2
(45) Date of Patent: Feb. 5, 2008

(54) HOLE OPENER

(75) Inventors: Shafagat Fakhrazovich Takhaundinov, Almetievsk (RU); Nail Gabdulbarievich Ibragimov, Almetievsk (RU); Khamit Zagirovich Kaveev, Almetievsk (RU); Gabdrashit Sultanovich Abdrakhmanov, Bugulma (RU); Nigamatian Khamitovich Khamitianov, Bugulma (RU); Ilgiz Kamaevich Kashapov, Bugulma (RU); Ruslan Gabdrashitovich Abdrakhmanov, Moscow (RU)

(73) Assignee: Otkrytoe Aktsionernoe Obschestvo "Tatneft" IM. V.D. Shashina, Almetievsk (RU)

( * ) Notice: Subject to any disclaimer, the term of this patent is extended or adjusted under 35 U.S.C. 154(b) by 98 days.

(21) Appl. No.: 10/533,373

(22) PCT Filed: Mar. 30, 2004

(86) PCT No.: PCT/RU2004/000117

§ 371 (c)(1),
(2), (4) Date: Apr. 29, 2005

(87) PCT Pub. No.: WO2004/090277

PCT Pub. Date: Oct. 21, 2004

(65) Prior Publication Data

US 2006/0118339 A1 Jun. 8, 2006

(30) Foreign Application Priority Data

Apr. 11, 2003 (RU) ..... 2003110466

(51) Int. Cl.
*E21B 10/32* (2006.01)
*E21B 10/34* (2006.01)

(52) U.S. Cl. ..... 175/269; 175/344; 175/406

(58) Field of Classification Search ..... 175/271, 175/269, 265, 284, 406, 384, 344
See application file for complete search history.

(56) References Cited

U.S. PATENT DOCUMENTS 1,548,578 A * 8/1925 Blanchard ..... 175/269

(Continued)

FOREIGN PATENT DOCUMENTS

RU 2027843 1/1995

(Continued)

OTHER PUBLICATIONS

Partial English Translation of Claims of RU 2172385 dated Aug. 20, 2001.

(Continued)

*Primary Examiner*—David Bagnell
*Assistant Examiner*—Robert Fuller
(74) *Attorney, Agent, or Firm*—Ladas & Parry LLP

(57) ABSTRACT

The invention relates to well reamer for borehole reaming within a specified interval. The well reamer has a housing with inclined slots, radial holes and a central straight-through channel, in which a spring-loaded rod with holes in the upper and lower parts is located. The upper holes of the rod are covered when the operating elements are extended into an operating position. A plurality of legs, including cutters rotatably supported on the legs, are moved by pistons between an operating position and a transport position along the inclined slots. Free-ends of the pistons may be connected to the rod by sliders, which are movable radially into openings in the rod to connect the rod to the pistons to move the rod with the legs.

8 Claims, 2 Drawing Sheets

U.S. PATENT DOCUMENTS

| | | | | |
|---|---|---|---|---|
| 3,171,503 | A | 3/1965 | Shirley | |
| 2004/0065480 | A1* | 4/2004 | Fanuel et al. | 175/269 |

FOREIGN PATENT DOCUMENTS

| | | |
|---|---|---|
| RU | 2172385 | 8/2001 |
| SU | 582373 | 11/1977 |
| SU | 874952 | 11/1977 |

OTHER PUBLICATIONS

Partial English Translation of Claims of SU 582373 dated Nov. 30, 1977.

Partial English Translation of Claims of SU 874952 dated Nov. 30, 1977.

Partial English Translation of Claims of RU 2027843 dated Jan. 27, 1995.

* cited by examiner

HOLE OPENER

FIELD OF INVENTION

The invention relates to drilling technique, in particular, to devices for borehole reaming within a specified interval.

DESCRIPTION OF RELATED ART

There is known a well reamer, comprising a housing with inclined slots and a piston placed in it which is spring-loaded through a rod, legs with journals fixed in inclined slots of the housing, on which journals cantilevered rolling cutters are provided (Inventor's certificate of the USSR No 582373, class E21B 7/28, 1971).

A shortcoming of the known device is the lack of reliable centering in a well, since no more than two operating elements may be provided in the housing without detriment to its strength. This results in vibration and whipping during the process of well reaming. In so doing the surface of the reamed well section becomes irregular, which does not provide for quality installation of profile liner during well drilling. The rate of borehole reaming is also low.

Additionally, in the known reamer, the rolling cutters are fixed on cantilevered legs without fixing the free ends of journals, which lowers the strength of operating elements and leads to breakage at heavy mechanical loads.

There is another known reamer, which comprises a housing with inclined slots and a central straight-through channel in which a rod is placed and spring-loaded towards the lower end of the housing, legs with journals fixed in inclined slots of the body, on which journals rolling cutters are provided and supported. Free ends of the journals are fastened, and interact with the rod through pushers (Patent of the Russian Federation No 2172385 class E21B 7/28, 2001).

Shortcomings of this device include low serviceability and reliability due to presence in its design of a ring piston, rigidly connected with the rod, and pushers of supports in the form of two-member links, which cannot withstand heavy power loads. Additionally, the design of the known reamer does not allow control over settings of the operating elements into working position.

SUMMARY OF THE INVENTION

An object of the invention is to increase of serviceability and reliability of a reamer.

The object is achieved by a well reamer, comprising a housing with inclined slots and a central straight-through channel, in which a rod is placed and spring-loaded towards a lower end of the housing. Legs having journals are provided in the inclined slots of the housing, and rolling cutters are provided and supported by the journals. The free ends of the journals are secured, and interact with the rod through pushers. According to the invention, the pushers are made in the form of cylindrical pistons, disposed in inclined bores of the housing and tightened relative to its straight-through channel and annulus environment. First ends are connected to the supports, and other ends are connected to the rod with the possibility of radial movements with respect to the walls of the housing. The central straight-through channel of the housing communicates with the environment through first and second holes in the walls of the housing and the rod. Those holes are covered while extending the legs and the cutters to an operating position.

DETAILED DESCRIPTION OF THE PREFERRED EMBODIMENT

Figure 1:
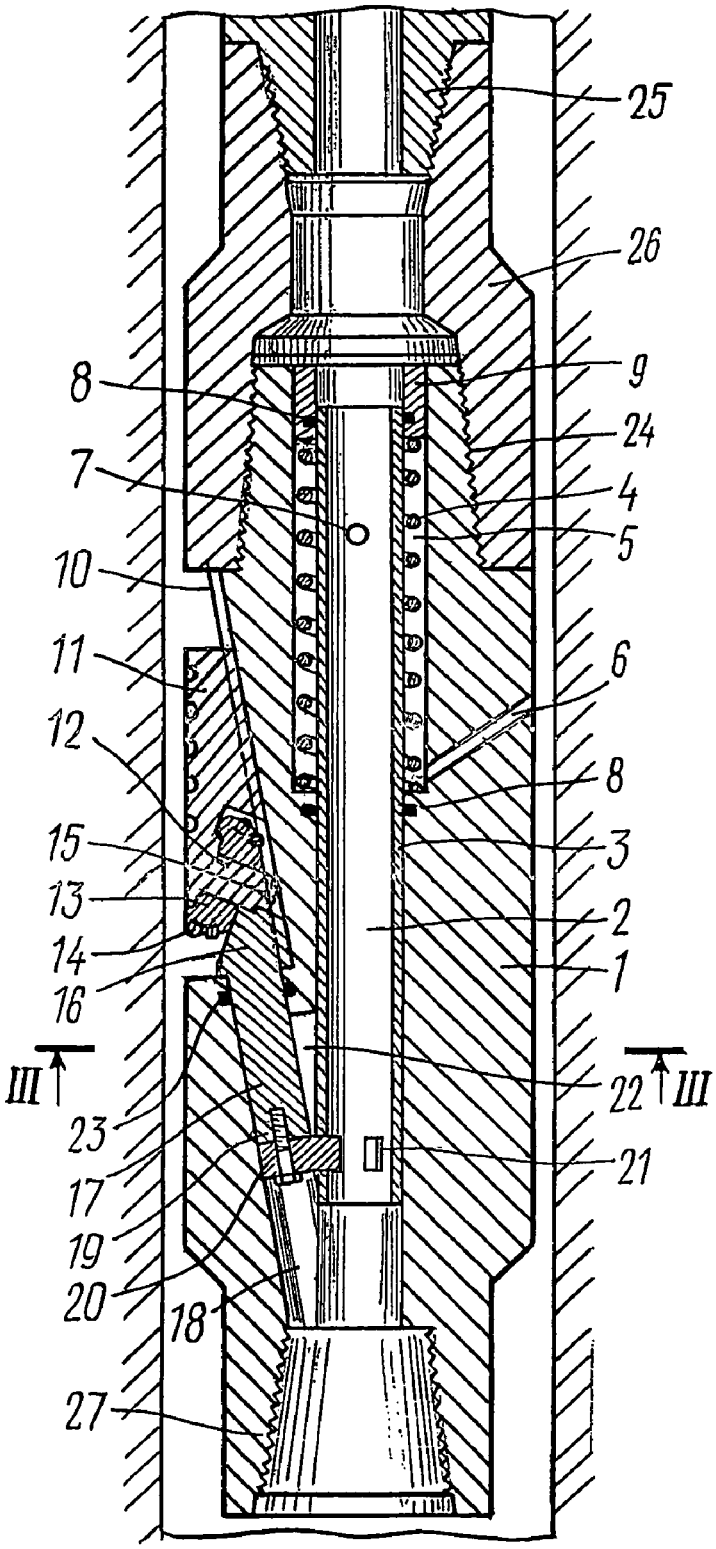
FIG. 1 is a longitudinal section of a reamer in accordance with the present invention in the transport position.
Figure 3:
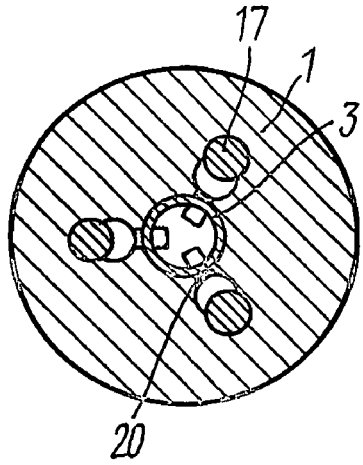
FIG. 3 is a sectional view taken on 111-111 in FIG. 1.

A well reamer (FIG. 1) comprises a housing 1 with a central straight-through channel 2, in which rod 3 is placed and spring-loaded by a spring 4 towards the lower end of the housing 1. The spring 4 is positioned in a chamber 5, which is formed by an inner wall of the housing 1 and an outer wall of the rod 3. The chamber 5 communicates through first holes 6 in the wall of the housing 1 with the environment and through second holes 7 in the wall of the rod 3—with the central straight-through channel 2 of the housing 1. The chamber 5 is isolated from the straight-through channel 2 by seals 8, and the second holes 7 of the rod 3 may be covered by a thrust bushing 9 after the rod 3 has come to the upper most position.

The housing 1 has outer inclined first slots 10 (FIG. 1, 3) of "dovetail" type, in which legs 11 are provided with journals 12. On the journals 12, cutters 13 with hard-alloy teeth 14 are provided for rotation about the journals 12. The legs 11, acting as calibrators, are provided with similar teeth. Free ends 15 of the journals 12 are supported by supports 16, which are also installed in the inclined first slots 10 of the housing 1 and are rigidly connected to cylindrical pistons 17, arranged in inclined bores 18 of the housing 1. The pistons have free ends 19 and sliders 20 which may be secured in third holes (openings) 21 of the rod 3 with the possibility of radial movements. The bores 18 through a longitudinal second slot 22 of the housing 1 communicate with the straight-through channel 2 of the housing 1 and are isolated from the environment by seals 23.

On ends of the housing 1 some threads are provided: a thread 24 for connection with drill string 25 (FIG. 2) through a reducer 26, and a thread 27 for attaching of a drilling bit having bean washout ports (not shown).

The well reamer operates in the following way.

Figure 2:
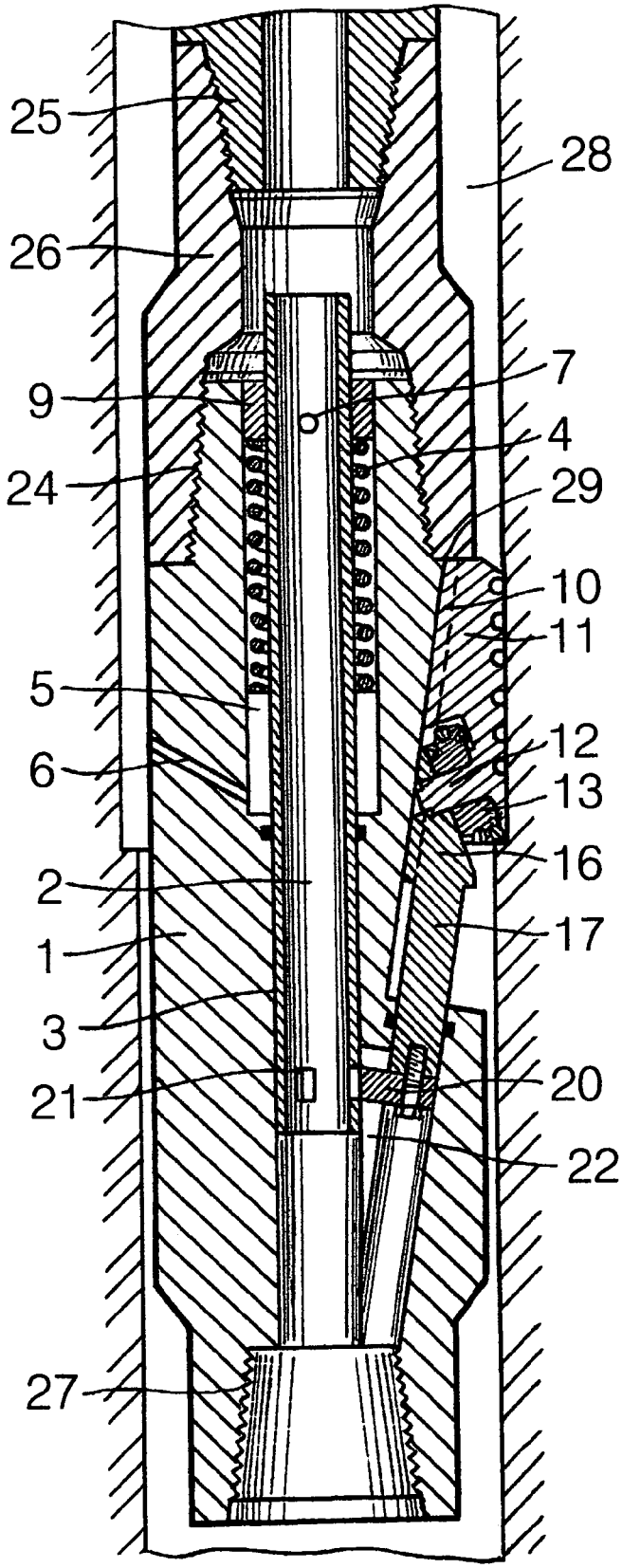
FIG. 2 shows the reamer of FIG. 1 in the operating position.

A drilling bit (not shown) is screwed in the thread 27 of the housing 1, and the reducer 26 is screwed on the thread 24, the reamer is connected to the drill string 25 and inserted into a well 28 (FIG. 2).

At the prescribed well depth, one starts rotation of the drill string 25 and simultaneously supplies into it a washing fluid, which flows into the central straight-through channel 2 of the housing 1 and further—into washout ports of the bit, in which differential pressure is created. As the differential pressure above the bit increases, pistons 17 connected with the rod 3 by the sliders 20 overcome the power of spring 4 and move the supports 16, the cutters 13, and the legs 11 along the inclined first slots 10 into the operating position, up to the stop at an end face 29 of the reducer 26. At that position, the fluid from the chamber 5 is displaced into annulus environment of the well 28 through the first holes 6 of the housing 1, while the second holes 7 in the rod 3 are covered by the thrust bushing 9, which results in an abrupt pressure increase in the reamer and serves as a signal that operating elements (the legs 11 and the cutters 13) of the reamer have been extended into the operating position. Further, by moving the reamer downward, the well is reamed within a specified interval.

Upon completion of the borehole reaming, the fluid injection into the drill string 25 is ceased. In so doing the spring 4, being extended, returns the rod 3 and the pistons 17 connected therewith as well as the supports 16 and the legs 11 with the cutters 13 to a transport position.

In moving the operating elements between the working position and the transport position the sliders 20, which are connected to the pistons 17 moving through second slots 22 in the housing 1, make radial movement in the third holes (openings) 21 of the rod 3—moving into and out of the third holes (openings) 21.

Such a design of the reamer provides an improved mechanism for extending the operating elements extension into the operating position and control over the extension, which increases serviceability and reliability of the reamer.

What we claim is:

1. A well reamer comprising a housing having a central channel, a plurality of inclined slots, and a plurality of inclined bores;

a rod in the central channel;

a spring biasing the rod toward a lower end of the housing;

a plurality of legs supported for movement along the inclined slots; the legs include a plurality of cutters supported on the legs; and a plurality of pistons in the inclined bores; the pistons are operatively connected to the legs to move the legs and the cutters between an operating position and a transport position along the inclined slots;

wherein each of the legs is connected to a respective one of the plurality of pistons; each of the plurality of pistons has a free-end that is operatively connected to the rod in the central channel so that the rod and the legs are movable by the pistons between the operating position and the transport position.

2. The well reamer according to claim 1, wherein the legs include teeth on an outer surface.

3. The well reamer according to claim 1, further comprising sliders connecting the free-ends of the pistons to the rod.

4. The well reamer according to claim 1, wherein each of the plurality of pistons is cylindrical.

5. The well reamer according to claim 1, wherein the housing comprises a first end for connecting to a drill string and a second end for connecting to a bit, and wherein the well reamer consists of components, including said housing, said rod, said spring, said plurality of legs, said plurality of cutters, and said plurality of pistons, which components are disposed in the well reamer such that a fluid introduced into the central channel can flow through the central channel from said first end to said second end and into washout ports of the bit.

6. The well reamer according to claim 5, wherein the first end of the housing comprises first thread means for connecting the housing to the drill string and the second end of the housing comprises second thread means for connecting the housing to the bit.

7. A well reamer comprising a housing having a central channel a plurality of inclined slots and a plurality of inclined bores;

a rod in the central channel;

a spring biasing the rod toward a lower end of the housing;

a plurality of legs supported for movement along the inclined slots; the legs include a plurality of cutters supported on the legs; and a plurality of pistons in the inclined bores; the pistons are operatively connected to the legs to move the legs and the cutters between an operating position and a transport position along the inclined slots;

wherein each of the legs is connected to a respective one of the plurality of pistons; each of the plurality of pistons has a free-end that is operatively connected to the rod in the central channel so that the rod and the legs are movable by the pistons between the operating position and the transport position, wherein the cutters are supported for rotation at an acute angle with respect to a longitudinal axis of the reamer.

8. A well reamer comprising a housing having a central channel, a plurality of inclined slots, and a plurality of inclined bores;

a rod in the central channel;

a spring biasing the rod toward a lower end of the housing;

a plurality of legs supported for movement along the inclined slots; the legs include a plurality of cutters supported on the legs; and a plurality of pistons in the inclined bores; the pistons are operatively connected to the legs to move the legs and the cutters between an operating position and a transport position along the inclined slots;

wherein each of the legs is connected to a respective one of the plurality of pistons; each of the plurality of pistons has a free-end that is operatively connected to the rod in the central channel so that the rod and the legs are movable by the pistons between the operating position and the transport position, further comprising sliders connecting the free-ends of the pistons to the rod, wherein the rod has openings at a lower end, the sliders sliding radially into and out of the openings of the rod as the legs are moved between the operating position and the transport position.

* * * * *